United States Patent [19]

Orter

[11] 4,259,971

[45] Apr. 7, 1981

[54] CIGARETTE SMOKING DEVICE

[76] Inventor: Ralph H. Orter, P.O. Box 2074, Prescott, Ariz. 86302

[21] Appl. No.: 970,634

[22] Filed: Dec. 18, 1978

[51] Int. Cl.[3] ..... A24F 13/02

[52] U.S. Cl. ..... 131/178; 131/187; 131/330

[58] Field of Search ..... 131/187, 171 R, 191, 131/223, 190

[56] References Cited

U.S. PATENT DOCUMENTS

| | | | |
|---|---|---|---|
| 402,681 | 5/1889 | Lindeman | 131/171 R |
| 2,596,905 | 5/1952 | Less | 131/171 R |
| 2,709,441 | 5/1955 | Motsinger | 131/171 R X |
| 3,318,315 | 5/1967 | Orter | 131/171 R |

*Primary Examiner*—Stephen C. Pellegrino

[57] ABSTRACT

A dual purpose cigarette holder which may be used to smoke a cigarette manually, or when modified, functions as a filtered cigarette holder for filtering smoke inhaled by user. The holder includes a tubular body having a mouthpiece on end and a metal insert for holding a cigarette on the other end. The body includes a chamber divided into two portions each including a check valve therein and openings in the wall thereof. In the form of a manually operated smoking device, a resilient, collapsible member is removeably engaged about the tubular body enclosing said openings. In the form of a filtered cigarette holder, the collapsible member is removed and replaced by a filter element.

1 Claim, 5 Drawing Figures

CIGARETTE SMOKING DEVICE

The present invention relates to a dual purpose cigarette smoking holder which provides for, in one form, a device for drawing smoke from a cigarette by manually applying a vacuum through the cigarette holder, and in an alternative form, a cigarette holder with means to filter smoke drawn from a cigarette by application of a vacuum through the cigarette holder by the smoker's mouth.

In accordance with the present invention there is provided a device which includes a cigarette holder consisting of a tubular body, a mouthpiece on one end and a cigarette gripping means on the other end. Within the tubular body is a chamber divided by a baffle. Each divided portion of the chamber contains a check valve and at least one opening in the tubular wall. A resilient hollow collapsible member or a filter element is slidably fitted around and upon the tubular body, enclosing said openings.

Further objects and advantages of the invention may be apparent from the following drawings in which.

Figure 1:
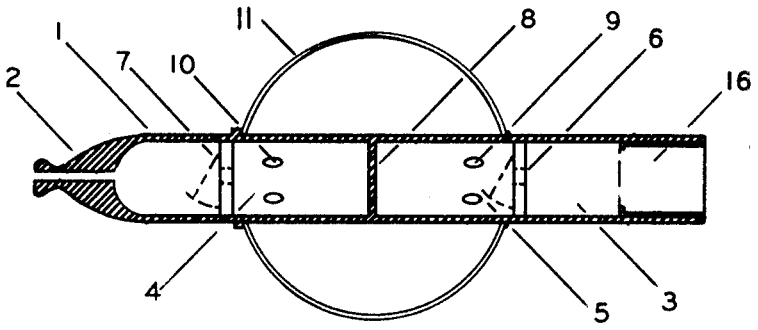
FIG. 1 is a central longitudinal section of the cigarette holder with the compressible hollow member.
Figure 2:
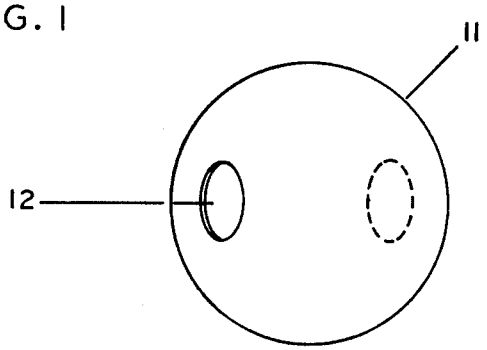
FIG. 2 shows the removeable hollow collapsible member.
Figure 3:
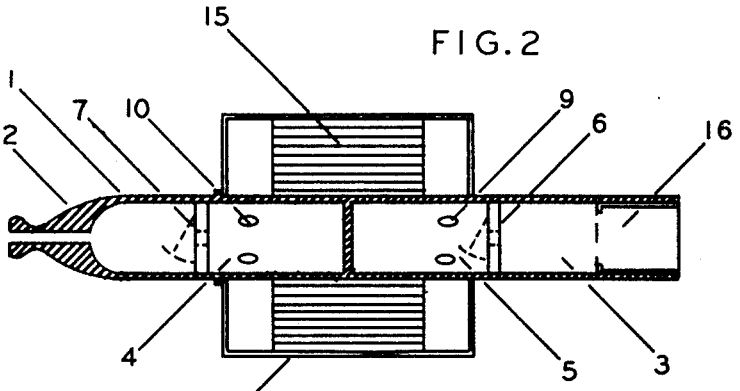
FIG. 3 is a central longitudinal section of the cigarette holder with the filter element.
Figure 4:
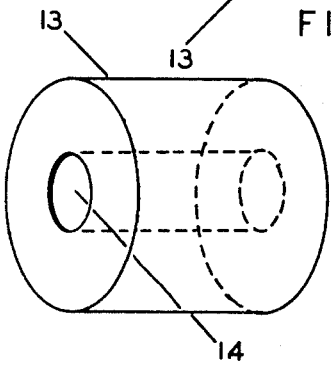
FIG. 4 shows the removeable filter element.
Figure 5:
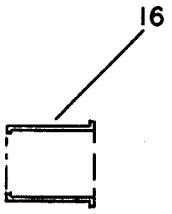
FIG. 5 shows the metal insert which fits within one end of the tubular cigarette holder.

As shown in FIG. 1 the invention includes a hollow body 1, a mouthpiece 2, on one end, a cigarette holder 3 on the other end of said body 1, a body chamber 4-5 positioned between said mouthpiece and said cigarette holder 3, an inlet check valve 6 between said cigarette holder 3 and said body chamber 5, an outlet check valve 7, between said mouthpiece 2 and said body chamber 4, a baffle divider 8 between said inlet check valve 6 and said outlet check valve 7, body chamber outlet openings 9 positioned between said inlet check valve 6 and said baffle divider 8, body chamber inlet openings 10 positioned between said outlet check valve 7 and baffle divider 8. A removeable resilient hollow collapsible member 11 with openings therein 12 is slidably fitted around and upon said cigarette holder body 1. Successive compressions and releases of said removeable member 11, alternately open and close the outlet check valve 7 and said inlet check valve 6 creating a vacuum to draw smoke from cigarette through inlet check valve 6 into said body chamber 5, through said body outlet chamber openings 9 into removeable member 11, through the body chamber inlet openings 10, into said body chamber 4, through said outlet check valve 7 and through mouthpiece 2 to the smoker, whereby cigarette holder body functions as a manual operated smoking device. By removing the removeable member 11 from the cigarette holder body 1 and slidably fitting the filtering member 13, as shown in FIGS. 3-4, with openings, 14 engaging said filtering member 13 around and upon said cigarette holder body 1, and with the use of the lips on the mouthpiece 2, smoke is drawn from the cigarette as the outlet check valve 7 and inlet check valve 6 open in tandum, and passes through the inlet check valve 6, through said body chamber 5, through said body chamber outlet openings 9, through filtering material 15, on through filtering member 13, through body chamber inlet openings 10 into said body chamber 4, through outlet check valve 7, through mouthpiece 2 to the smoker, whereby the cigarette smoking holder 1 now functions as an exceptionally efficient cigarette smoke filtering device.

I claim:

1. A dual purpose cigarette smoking holder consisting of a hollow body, a mouthpiece on one end of said body, a cigarette holder on the other end of said body, a body chamber positioned between said mouthpiece and said cigarette holder, an inlet check valve positioned between said cigarette holder and said body chamber, an outlet check valve positioned between said mouthpiece and said body chamber, a baffle divider between said outlet check valve and said inlet check valve, body chamber outlet openings positioned between said inlet check valve and baffle divider, body chamber inlet openings between said outlet check valve and said baffle divider, a press-fit metal insert within said cigarette holder to engage cigarette and protect said holder in event cigarette burns up completely; a resilient hollow collapsible member, having an opening therethrough said collapsible member being removeably engaged around and upon said cigarette holder body enclosing said inlet and outlet openings, whereupon successive compressing and releasing of said removeable member, the outlet check valve and said inlet check valve alternately open and close creating a vacuum to draw smoke from the cigarette through the inlet check valve, into one divided portion of said body chamber, through the body chamber outlet openings into said collapsible member, through said body chamber inlet openings into the other divided portion of said body chamber, through outlet check valve, through said mouthpiece to smoker, whereby said cigarette holder body functions as a manual operated cigarette smoking device; and further including a filter means, having an opening therethrough, said filter means adapted to removeably engage around and upon said holder body after said collapsible member is removed therefrom, said filter means enclosing said body chamber inlet and outlet openings, whereupon inhalation on the mouthpiece by a smoker, a vacuum is created opening outlet and inlet check valves in tandum, allowing smoke to flow from the cigarette through said inlet check valve, through one divided portion of said body chamber, through said outlet openings, through filtering material in said filter means; through said inlet openings into said other divided portion of said body chamber, and through said outlet check valve into the mouthpiece and to the smoker.

* * * * *